US010160937B2

(12) United States Patent
Reinoso Garcia et al.

(10) Patent No.: US 10,160,937 B2
(45) Date of Patent: Dec. 25, 2018

(54) AQUEOUS SOLUTION CONTAINING COMBINATION OF COMPLEXING AGENTS

(71) Applicants: BASF SE, Luwigshafen am Rhein (DE); PROCTER & GAMBLE COMPANY, Cincinnati, OH (US)

(72) Inventors: Marta Reinoso Garcia, Dossenheim (DE); Markus Christian Biel, Mannheim (DE); Dieter Boeckh, Limburgerhof (DE); Nathalie Sophie Letzelter, Newcastle upon Tyne (GB); Rohan Govind Murkunde, Newcastle upon Tyne (GB); Frank Huelskoetter, Bad Dürkheim (DE); Kevin George Goodall, Brüssel (BE)

(73) Assignee: BASF SE (DE)

( * ) Notice: Subject to any disclaimer, the term of this patent is extended or adjusted under 35 U.S.C. 154(b) by 0 days.

(21) Appl. No.: 15/529,820

(22) PCT Filed: Nov. 20, 2015

(86) PCT No.: PCT/EP2015/077194
§ 371 (c)(1),
(2) Date: May 25, 2017

(87) PCT Pub. No.: WO2016/083253
PCT Pub. Date: Jun. 2, 2016

(65) Prior Publication Data

US 2018/0002643 A1 Jan. 4, 2018

Related U.S. Application Data

(60) Provisional application No. 62/084,601, filed on Nov. 26, 2014.

(51) Int. Cl.

| | |
|---|---|
| ***C11D 3/33*** | (2006.01) |
| ***C11D 7/32*** | (2006.01) |
| ***C11D 3/37*** | (2006.01) |
| ***C11D 7/26*** | (2006.01) |

(52) U.S. Cl.
CPC ..... *C11D 7/3245* (2013.01); *C11D 3/33* (2013.01); *C11D 3/3723* (2013.01); *C11D 3/3773* (2013.01); *C11D 7/265* (2013.01); *C11D 7/32* (2013.01)

(58) Field of Classification Search
CPC ..... C11D 3/33; C11D 3/3723
USPC ..... 510/533
See application file for complete search history.

(56) References Cited

U.S. PATENT DOCUMENTS

| | | | | |
|---|---|---|---|---|
| 9,068,147 | B2 * | 6/2015 | Dobrawa | C11D 3/3723 |
| 9,732,309 | B2 * | 8/2017 | Garcia Marcos | C11D 3/3723 |
| 9,994,797 | B2 * | 6/2018 | Hueffer | C11D 3/0073 |
| 2013/0284210 | A1 | 10/2013 | Hueffer et al. | |
| 2016/0097020 | A1 | 4/2016 | Biel et al. | |
| 2016/0130531 | A1 | 5/2016 | Biel et al. | |
| 2016/0221931 | A1 | 8/2016 | Reinoso Garcia et al. | |
| 2017/0058239 | A1 | 3/2017 | Hartmann et al. | |
| 2017/0240852 | A1 | 8/2017 | Reinoso Garcia et al. | |
| 2017/0247318 | A1 | 8/2017 | Reinoso Garcia et al. | |

FOREIGN PATENT DOCUMENTS

| | | | |
|---|---|---|---|
| EP | 2821471 | A1 | 1/2015 |
| WO | WO-2014191198 | A1 | 12/2014 |

OTHER PUBLICATIONS

International Search Report for PCT/EP2015/077194 dated Jan. 29, 2016.
Written Opinion of the International Searching Authority for PCT/EP2015/077194 dated Jan. 29, 2016.

* cited by examiner

*Primary Examiner* — Gregory E Webb
(74) *Attorney, Agent, or Firm* — Drinker Biddle & Reath LLP

(57) ABSTRACT

Aqueous formulation with a content of (A) and (B) in the range of 40% to 60%, containing
(A) a complexing agent selected from methylglycine diacetic acid (MGDA) that is at least partially neutralized with alkali metal, and at least one complexing agent other than MGDA selected from
(B) glutamic acid diacetic acid (GLDA) that is at least partially neutralized with alkali metal, and, optionally,
(C) a polymer being selected from polyamines, the N atoms being partially or fully substituted with $CH_2COOH$ groups, partially or fully neutralized with alkali metal cations, and, optionally,
(D) at least one alkali metal salt of an organic acid, said acid being selected from mono- and dicarboxylic acids,
wherein the weight ratio of complexing agent (A) to complexing agent (B) is in the range of from 10:1 to 1:10.

15 Claims, No Drawings

AQUEOUS SOLUTION CONTAINING COMBINATION OF COMPLEXING AGENTS

CROSS-REFERENCE TO RELATED APPLICATIONS

This application is a national stage application (under 35 U.S.C. § 371) of PCT/EP2015/077194, filed Nov. 20, 2015, which claims benefit of U.S. Application No. 62/084,601, filed Nov. 26, 2014.

The present invention is directed towards aqueous formulations with a content of (A) and (B) in the range of 40% to 60%, containing (A) a complexing agent selected from methylglycine diacetic acid (MGDA) that is at least partially neutralized with alkali metal, and at least one complexing agent other than MGDA selected from (B) glutamic acid diacetic acid (GLDA) that is at least partially neutralized with alkali metal, and, optionally, (C) a polymer being selected from polyamines, the N atoms being partially or fully substituted with $CH_2COOH$ groups, partially or fully neutralized with alkali metal cations, and, optionally, (D) at least one alkali metal salt of an organic acid, said acid being selected from mono- and dicarboxylic acids, wherein the weight ratio of complexing agent (A) to complexing agent (B) is in the range of from 10:1 to 1:10.

Complexing agents such as methyl glycine diacetic acid (MGDA) and glutamic acid diacetic acid (GLDA) and their respective alkali metal salts are useful sequestrants for alkaline earth metal ions such as $Ca^{2+}$ and $Mg^{2+}$. For that reason, they are recommended and used for various purposes such as laundry detergents and for automatic dishwashing (ADW) formulations, in particular for so-called phosphate-free laundry detergents and phosphate-free ADW formulations. For shipping such complexing agents, in most cases either solids such as granules are being applied or aqueous solutions.

Many industrial users wish to obtain complexing agents in aqueous solutions that are as highly concentrated as possible. The lower the concentration of the requested complexing agent the more water is being shipped. Said water adds to the costs of transportation, and it has to be removed later. Although about 40% by weight solutions of MGDA and even 45% by weight solutions of GLDA can be made and stored at room temperature, local or temporarily colder solutions may lead to precipitation of the respective complexing agent, as well as nucleating by impurities. Said precipitations may lead to incrustations in pipes and containers, and/or to impurities or inhomogeneity during formulation.

Granules and powders are useful because the amount of water shipped can be neglected but for most mixing and formulation processes an extra dissolution step is required.

Highly concentrated aqueous solutions of MGDA and of GLDA can be made under certain circumstances. However, their viscosity in many cases leaves room for improvement. Aqueous solutions of MGDA have extremely low a viscosity, and in many operations a higher viscosity is desirable, e.g., in order to avoid splashing of such solutions during processing. On the other hand, highly concentrated aqueous solutions of GLDA at ambient temperature exhibit a high viscosity. Simple combinations of GLDA and MGDA do not solve the problem.

Additives that may enhance the solubility of the respective complexing agents may be considered but such additives should not negatively affect the properties of the respective complexing agent.

It was therefore the objective of the present invention to provide highly concentrated aqueous solutions of complexing agents that are stable at temperatures in the range from zero to 50° C. It was further an objective of the present invention to provide a method for manufacture of highly concentrated aqueous solutions of complexing agents that are stable at temperatures in the range from zero to 50° C. Neither such method nor such aqueous solution should require the use of additives that negatively affect the properties of the respective complexing agent.

Accordingly, the formulations defined at the outset have been found, hereinafter also being referred to as aqueous formulations according to the (present) invention.

Aqueous solutions according to the invention contain (A) a complexing agent selected from methylglycine diacetic acid (MGDA) that is at least partially neutralized with alkali metal, and at least one complexing agent other than MGDA selected from (B) glutamic acid diacetic acid (GLDA) that is at least partially neutralized with alkali metal, and, optionally, (C) a polymer being selected from polyamines, the N atoms being partially or fully substituted with $CH_2COOH$ groups, partially or fully neutralized with alkali metal cations, and, optionally, (D) at least one alkali metal salt of an organic acid, said acid being selected from mono- and dicarboxylic acids, wherein the weight ratio of complexing agent (A) to complexing agent (B) is in the range of from 10:1 to 1:10, and wherein the content of (A) and (B) is in the range of 40% to 60%.

The aqueous formulations according to the present invention are preferably solutions. That means, by visible inspection aqueous formulations according to the present invention appear clear and transparent, for example a 0.5 cm thick layer of an aqueous formulation according to the present invention at ambient temperature.

In the context of the present invention, the terms "neutralized with alkali metal" and "neutralized with alkali metal cations" is being used interchangeably.

In the context of the present invention, complexing agent (A) is selected from lithium salts, potassium salts and preferably sodium salts of methylglycine diacetic acid. Complexing agent (A) can be partially or preferably fully neutralized with the respective alkali metal. In a preferred embodiment, an average of from 2.7 to 3 COOH groups per molecule of MGDA is neutralized with alkali metal, preferably with sodium. In a particularly preferred embodiment, complexing agent (A) is the trisodium salt of MGDA.

Complexing agent (A) can be selected from racemic mixtures of alkali metal salts of MGDA and of the pure enantiomers such as alkali metal salts of L-MGDA, alkali metal salts of D-MGDA and of mixtures of enantiomerically enriched isomers.

In any way, minor amounts of complexing agent (A) may bear a cation other than alkali metal. It is thus possible that minor amounts, such as 0.01 to 5 mol-% of total complexing agent (A) bear alkali earth metal cations such as $Mg^{2+}$ or $Ca^{2+}$, or an $Fe^{+2}$ or $Fe^{+3}$ cation.

In the context of the present invention, complexing agent (B) is selected from lithium salts, potassium salts and preferably sodium salts of glutamic acid diacetic acid. Complexing agent (B) can be fully or preferably partially neutralized with the respective alkali. In a preferred embodiment, an average of from 3.5 to 4 COOH groups per molecule of GLDA is neutralized with alkali metal, preferably with sodium. In a particularly preferred embodiment, an average of from 3.5 to 3.8 COOH groups per molecule of GLDA is neutralized with sodium.

In any way, minor amounts of complexing agent (B) may bear a cation other than alkali metal. It is thus possible that minor amounts, such as 0.01 to 5 mol-% of total complexing agent (B) bear alkali earth metal cations such as $Mg^{2+}$ or $Ca^{2+}$, or an $Fe^{+2}$ or $Fe^{+3}$ cation.

Complexing agent (B) can be selected from racemic mixtures of alkali metal salts of GLDA and of the pure enantiomers such as alkali metal salts of L-GLDA, alkali metal salts of D-GLDA and of mixtures of enantiomerically enriched isomers. In a preferred embodiment, complexing agent (B) is essentially L-glutamic acid (L-GLDA) that is at least partially neutralized with alkali metal. "Essentially L-glutamic acid" shall mean that complexing agent (B) contains more than 95% by weight of L-GLDA and less than 5% by weight D-GLDA, each at least partially neutralized with alkali metal.

In one embodiment of the present invention, complexing (B) does not contain detectable amounts of D-GLDA. The analysis of the enantiomers can be performed by measuring the polarization of light (polarimetry) or preferably by chromatography, for example by HPLC with a chiral column.

Preferably, both complexing agents (A) and (B) are at least partially neutralized with sodium.

The weight ratio of complexing agent (A) to complexing agent (B) is in the range of from 10:1 to 1:10. In one embodiment of the present invention, the weight ratio of complexing agent (A) to complexing agent (B) is in the range of from 4:1 to 1:4, preferably from 2:1 to 1:2 an even more preferably from 1.5:1 to 1:1.5.

In one embodiment of the present invention, aqueous formulations according to the invention have a pH value in the range of from 9.5 to 12, preferably of from 10.5 to 11, determined at a 1% by weight aqueous solution, preferably at ambient temperature. Aqueous formulations according to the present invention with the above pH value are harmless to many materials including various polymers. In particular, aqueous formulations according to the present invention with a pH value in the range of from 10.5 to 11 neither dissolve nor swell polyvinylalcohol (PVA) films.

In one embodiment of the present invention, aqueous formulations according to the invention have a content of complexing agent (A) and complexing agent (B) in the range of from 40 to 60%, preferably from 45 to 55%. The term "content of complexing agent (A) and complexing agent (B)" refers to the sum of the contents of complexing agent (A) and complexing agent (B). It may be determined by measuring the total $Fe^{3+}$ binding capacity by titration.

Aqueous solutions according to the invention may further contain polymer (C). Polymer (C) is selected from polyamines, the N atoms being partially or fully substituted with $CH_2COOH$ groups, partially or fully neutralized with alkali metal cations.

The term "polyamine" in the context with polymer (C) refers to polymers and copolymers that contain at least one amino group per repeating unit. Said amino group may be selected from $NH_2$ groups, NH groups and preferably tertiary amino groups. In polymer (C), tertiary amino groups are preferred since the basic polyamine has been converted to carboxymethyl derivatives, and the N atoms are fully substituted or preferably partially, for example 50 to 95 mol-%, preferably 70 to 90 mol-%, substituted with $CH_2COOH$ groups, partially or fully neutralized with alkali metal cations. In the context of the present invention, such polymers (C) in which more than 95 mol-% to 100 mol-% of the N atoms are substituted with $CH_2COOH$ groups will be considered to be fully substituted with $CH_2COOH$ groups. $NH_2$ groups from, e.g., polyvinylamines or polyalkylenimines can be substituted with one or two $CH_2COOH$ group(s) per N atom, preferably with two $CH_2COOH$ groups per N atom.

The numbers of $CH_2COOH$ groups in polymer (C) divided by the potential total number of $CH_2COOH$ groups, assuming one $CH_2COOH$ group per NH group and two $CH_2COOH$ groups per $NH_2$ group, will also be termed as "degree of substitution" in the context of the present invention.

The degree of substitution can be determined, for example, by determining the amine numbers (amine values) of polymer (C) and its respective polyamine before conversion to the $CH_2COOH$-substituted polymer (C), preferably according to ASTM D2074-07.

Examples of polyamines are polyvinylamine, polyalkylenepolyamine and in particular polyalkylenimines such as polypropylenimines and polyethylenimine.

Within the context of the present invention, polyalkylenepolyamines are preferably understood as meaning those polymers which comprise at least 6 nitrogen atoms and at least five $C_2$-$C_{10}$-alkylene units, preferably $C_2$-$C_3$-alkylene units, per molecule, for example pentaethylen-hexamine, and in particular polyethylenimines with 6 to 30 ethylene units per molecule. Within the context of the present invention, polyalkylenepolyamines are to be understood as meaning those polymeric materials which are obtained by homo- or copolymerization of one or more cyclic imines, or by grafting a (co)polymer with at least one cyclic imine. Examples are polyvinylamines grafted with ethylenimine and polyimidoamines grafted with ethylenimine.

Preferred polmers (C) are polyalkylenimines such as polyethylenimines and polypropylenimines, polyethylenimines being preferred. Polyalkylenimines such as polyethylenimines and polypropylenimines can be linear, essentially linear or branched.

In one embodiment of the present invention, polyethylenimines are selected from highly branched polyethylenimines. Highly branched polyethylenimines are characterized by their high degree of branching (DB). The degree of branching can be determined, for example, by $^{13}C$-NMR spectroscopy, preferably in $D_2O$, and is defined as follows:

$$DB=D+T/D+T+L$$

with D (dendritic) corresponding to the fraction of tertiary amino groups, L (linear) corresponding to the fraction of secondary amino groups and T (terminal) corresponding to the fraction of primary amino groups.

Within the context of the present invention, highly branched polyethylenimines are polyethylenimines with DB in the range from 0.25 to 0.90.

In one embodiment of the present invention, polyethylenimine is selected from highly branched polyethylenimines (homopolymers) with an average molecular weight $M_w$ in the range from 600 to 75 000 g/mol, preferably in the range from 800 to 25 000 g/mol.

In another embodiment of the present invention, polyethylenimines are selected from copolymers of ethylenimine, such as copolymers of ethylenimine with at least one diamine with two $NH_2$ groups per molecule other than ethylenimine, for example propylene imine, or with at least one compound with three $NH_2$ groups per molecule such as melamine.

In one embodiment of the present invention, polymer (C) is selected from branched polyethylenimines, partially or fully substituted with $CH_2COOH$ groups, partially or fully neutralized with $Na^+$.

Within the context of the present invention, polymer (C) is used in covalently modified form, and specifically such that in total up to at most 100 mol-%, preferably in total 50 to 98 mol-%, of the nitrogen atoms of the primary and secondary amino groups of the polymer (C)—percentages being based on total N atoms of the primary and secondary amino groups in polymer (C)—have been reacted with at least one carboxylic acid such as, e.g., Cl—$CH_2COOH$, or at least one equivalent of hydrocyanic acid (or a salt thereof) and one equivalent of formaldehyde. Within the context of the present application, said reaction (modification) can thus be, for example, an alkylation. Most preferably, up to at most 100 mol-%, preferably in total 50 to 99 mol-%, of the nitrogen atoms of the primary and secondary amino groups of the polymer (C) have been reacted with formaldehyde and hydrocyanic acid (or a salt thereof), for example by way of a Strecker synthesis. Tertiary nitrogen atoms of polyalkylenimine that may form the basis of polymer (C) are generally not bearing a $CH_2COOH$ group.

Polymer (C) can, for example, have an average molecular weight ($M_n$) of at least 500 g/mol; preferably, the average molecular weight of polymer (C) is in the range from 500 to 1,000,000 g/mol, particularly preferably 800 to 50,000 g/mol, determined determination of the amine numbers (amine values), for example according to ASTM D2074-07, of the respective polyamine before alkylation and after and calculation of the respective number of $CH_2COOH$ groups. The molecular weight refers to the respective per-sodium salt.

In aqueous solutions according to the invention, the $CH_2COOH$ groups of polymer (C) are partially or fully neutralized with alkali metal cations. The non-neutralized groups COOH can be, for example, the free acid. It is preferred that 90 to 100 mol-% of the $CH_2COOH$ groups of polymer (C) are in neutralized form.

It is preferred that the neutralized $CH_2COOH$ groups of polymer (C) are neutralized with the same alkali metal as complexing agent (A).

$CH_2COOH$ groups of polymer (C) may be neutralized, partially or fully, with any type of alkali metal cations, preferably with $K^+$ and particularly preferably with $Na^+$.

In one embodiment of the present invention, aqueous formulations according to the invention have a total solids content in the range of from 40 to 70%, preferably from 48 to 60%. The solids content is determined by measuring the $Fe^{3+}$ binding capacity by titration. The addition of salt (D) is being taken into account by calculation.

Aqueous solutions according to the present invention further contain (D) at least one alkali metal salt of an organic acid, said acid being selected from di- and preferablymonocarboxylic acids.

Examples of dicarboxylic acid are tartaric acid, adipic acid, glutamic acid, maleic acid, fumaric acid, and malic acid. Salts of dicarboxylic acids may be selected from the mono- and preferably the dialkalimetal salts.

Examples of monocarboxylic acids are formic acid and acetic acid and lactic acid, acetic acid and formic acid being preferred.

Suitable alkali metals are lithium, rubidium, preferred is sodium and particularly preferred is potassium.

Preferred examples of salt (D) are potassium acetate and potassium formate.

In one embodiment of the present invention, aqueous formulations according to the invention contain in the range of from 10 to 50% by weight of complexing agent (A), preferably 12.5 to 40% by weight, more preferred 20 to 35% by weight;

in the range of from 10 to 50% by weight of complexing agent (B), preferably 12.5 to 40% by weight, more preferred 20 to 35% by weight;

in the range of from zero to 5% by weight of polymer (C), preferably 0.05 to 1% by weight, even more preferred 0.1 to 0.5% by weight;

in the range of from zero to 30% by weight of salt (D), preferably 1 to 10% by weight, percentages referring to the total solids of the respective aqueous solution.

In one embodiment of the present invention, aqueous formulations according to the invention may have a dynamic viscosity in the range of from 100 to 400 mPa·s, preferably 200 to 350 mPa·s, each determined according to DIN 53018-1:2008-09 at 25° C. Preferred way of determination is spindle 31.

In one embodiment of the present invention, aqueous formulations according to the invention may have a color number according to Hazen in the range of from 15 to 400, preferably to 360, determined according to DIN EN 1557: 1997-03 at 25° C.

In one embodiment of the present invention, aqueous formulations according to the invention are phosphate-free. The term "phosphate-free" in the context of the present invention shall refer to formulations that contain 0.5 or less % by weight of inorganic phosphates including but not limited to sodium tripolyphosphate ("STPP"). The percentage refers to the total solids content of the respective aqueous formulation according to the present invention, and it can be determined by gravimetric methods.

Aqueous formulations according to the present invention exhibit extremely low a tendency of having solid precipitates, such as of complexing agent (A) or of complexing agent (B) or of other solids. Therefore, they can be stored and transported in pipes and/or containers without any residue, even at temperatures close to the freezing point of the respective aqueous formulation according to the invention. In addition, the can be pumped and shipped easily due to their advantageous rheological properties. Transportation in a pipe or a container in the context of the present invention preferably does not refer to parts of the plant in which complexing agent (A) or complexing agent (B) are being manufactured, nor does it refer to storage buildings that form part of the respective production plant in which complexing agent (A) or complexing agent (B) has being manufactured. Containers can, for example, be selected from tanks, bottles, carts, road container, and tank wagons. Pipes can have any diameter, for example in the range of from 5 cm to 1 m, and they can be made of any material which is stable to the alkaline solution of complexing agent (A) and (B). Transportation in pipes can also include pumps that form part of the overall transportation system.

Preferably, aqueous formulations according to the present invention do not damage solid polymers, especially not polymers that are susceptible to hydrolytic transformations. Such polymers can be stored in close contact with aqueous formulations according to the present invention. An example of such polymers is polyvinyl alcohol.

Preferably, aqueous formulations according to the invention comprise at least one plasticizer. The plasticizer improves the storage stability of the aqueous formulations in a container composed of polymer. The plasticizer is chosen in such a way that the plasticizer is functioning as softener for the polymer the container is composed of. Preferred plasticizers for use in the aqueous formulations stored in containers composed of polyvinyl alcohol are for example glycerol, ethylene glycol, diethyleneglycol, propylene glycol, dipropylene glycol, sorbitol and mixtures thereof. Preferred amount of plasticizer is from 0.01 weight-% to 1.0 weight-% based on the total weight of the aqueous formulation.

Another aspect of the present invention is a method for making aqueous formulations according to the present invention, hereinafter also being referred to as inventive process. The inventive process comprises the step of combining complexing agent (A) with complexing agent (B). In embodiments in which polymer (C) is to be added, it is possible to add polymer (C) as a solid or preferably as aqueous solution. In embodiments in which salt (D) is to be added, it is possible to add salt (D) as a solid or preferably as aqueous solution. The order of addition of the components complexing agent (A), complexing agent (B), and—if desired—one or more salts (D) and/or polymer (C) is not critical. However, it is preferred to charge a vessel with an aqueous solution of complexing agent (A) and to then add complexing agent (B) and then, optionally, one or more salts (D), or to charge a vessel with an aqueous solution of complexing agent (A) and to then add the optional salt (D) and then complexing agent (B), or to charge a vessel with an aqueous solution of complexing agent (A) and to add complexing agent (B) and—optionally—one or more salts (D) simultaneously, and—in each case optionally—polymer (C). In one preferred embodiment, a vessel is charged with an aqueous solution of complexing agent (A) and then solid complexing agent (B) and solid salt (D) are added and, optionally, polymer (C). In other preferred embodiments, a vessel is charged with an aqueous solution of complexing agent (A). Then, aqueous solutions of complexing agent (B) and—optionally—one or more salts (D) and—optionally—of polymer (C) are added. In another preferred embodiment, a vessel is charged with an aqueous solution of complexing agent (B). Then, solid complexing agent (A) is added followed by the addition of an aqueous solution of—optionally—one or more salts (D) and—optionally—of an aqueous solution of polymer (C).

Salt (D) can be added as such or be generated in situ. In situ synthesis of salt (D) can be accomplished by adding the respective acid, for example the respective carboxylic acid or dicarboxylic acid, and an alkali metal hydroxide, for example sodium hydroxide or potassium hydroxide. For example, potassium formate can be added as solid or as aqueous solution, or potassium formate can be synthesized by adding formic acid and potassium hydroxide.

In a specific embodiment, a vessel is charged with an aqueous solution of complexing agent (A). Then, an aqueous solution of polymer (C) is added, followed by the addition of an aqueous solution of complexing agent (B). After that, salt (D) is being generated in situ by adding the respective carboxylic acid or dicarboxylic acid, followed by addition of an alkali metal hydroxide, for example sodium hydroxide or potassium hydroxide.

In one embodiment of the present invention, the inventive process may be performed at a temperature in the range of from 30 to 85° C., preferably 25 to 50° C. In another embodiment of the present invention, aqueous solution of complexing agent (A) can be combined with complexing agent (B) and salt (D) at ambient temperature or slightly elevated temperature, for example in the range of from 21 to 29° C.

The inventive process can be performed at any pressure, for example at a pressure in the range of from 500 mbar to 25 bar. Normal pressure is preferred.

The inventive process can be performed in any type of vessel, for example in a stirred tank reactor or in a pipe with means for dosage of polymer (C), or in a beaker, flask or bottle.

Removal of water can be achieved, for example, with the help of membranes or by evaporation. Evaporation of water can be performed by distilling off water, with or without stirring, at temperature in the range of from 20 to 65° C.

In order to adjust the pH value if desired, an organic acid such as formic acid, acetic acid, lactic acid, or a dicarboxylic acid can be added such as adipic acid, tartaric acid, malic acid, maleic acid, or fumaric acid, or a mixture of at least two of the forgoing acids. Addition of acetic acid or formic acid is preferred. In other embodiments, the pH value may be adjusted by addition of a base, for example NaOH or KOH.

The inventive process may be carried out under conditions that support fast mixing, for example under stirring.

Another aspect of the present invention is directed to the use of aqueous formulations according to the present invention for transportation in a pipe or a container. Transportation in a pipe or a container in the context of the present invention preferably does not refer to parts of the plant in which complexing agent (A) or complexing agent (B) are being manufactured, nor does it refer to storage buildings that form part of the respective production plant in which complexing agent (A) or complexing agent (B) have been manufactured. Containers can, for example, be selected from tanks, bottles, carts, road container, and tank wagons. Pipes can have any diameter, for example in the range of from 5 cm to 1 m, and they can be made of any material which is stable to the alkaline solution of complexing agent (A) and (B). Transportation in pipes can also include pumps that form part of the overall transportation system.

Aqueous solutions according to the present invention can be used for home care applications, especially for automatic dishwashing.

The invention is further illustrated by the following working examples.

WORKING EXAMPLES

In the context of the present invention, percentages refer to % by weight unless expressly noted otherwise.

The following substances were used:

Complexing agent (A.1): trisodium salt of MGDA, provided as 40% by weight aqueous solution, pH value: 13, or as powder, pH value of the respective 1% by weight aqueous solution: 13, residual moisture: 15% by weight Complexing agent (B.1): tetrasodium salt of L-GLDA, 47% aqueous solution Salt (D.1): potassium formate, generated in situ by addition of aqueous 50% KOH solution and concentrated formic acid Polymer (C.1): polyethylenimine, N atoms alkylated with $CH_2COOH$ groups, degree of substitution: 80.0 mol-%, COOH groups fully neutralized with NaOH, branched. $M_n$: 50,000 g/mol, determined by determined by determination of the amine numbers of polymer (B.1) and of its respective polyethylenimine, each determined according to ASTM D2074-07, 2007 edition, and calculation of the respective number of $CH_2COOH$ groups. The molecular weight refers to the respective sodium salt, all COOH groups being neutralized. Polymer (C.1) was applied as 40% by weight aqueous solution.

I. Manufacture of aqueous formulations containing complexing agents (A) and (B) according to the invention I.1 Manufacture of an aqueous solution containing (A.1), (B.1), (C.1) and (D.1)

A 250 ml flask was charged with 60 g of a 40% solution of complexing agent (A.1). Then, 0.3 g of a 40% aqueous solution of polymer (C.1) were added and stirred for 1 minute. Then, 51.1 g of a 47% aqueous solution of complexing agent (B.1) was added and stirred for 1 minute. After that, 10.67 g of a 50% aqueous solution of KOH were added and stirred for a minute and then 6.02 g of concentrated formic acid were added within 15 minutes, thereby, potassium formate (D.1) was formed in situ. The formulation so obtained was stirred for one hour, and then 28.09 g of water were removed by evaporation at 90° C. at normal pressure and under air.

The inventive formulation so obtained had a viscosity of 370 mPa·s (25° C.) and a density of 1.47 kg/l (23° C.).

The inventive formulation so obtained could be stored at −7° C. for more than 3 weeks without haze.

The invention claimed is:

1. An aqueous formulation with a content of (A) and (B) in the range of 40% to 60%, containing (A) a complexing agent selected from methylglycine diacetic acid (MGDA) that is at least partially neutralized with alkali metal, and at least one complexing agent other than MGDA selected from (B) glutamic acid diacetic acid (GLDA) that is at least partially neutralized with alkali metal, and, optionally, (C) a polymer being selected from polyamines, the N atoms being partially or fully substituted with $CH_2COOH$ groups, partially or fully neutralized with alkali metal cations, and, optionally, (D) at least one alkali metal salt of an organic acid, said acid being selected from mono- and dicarboxylic acids, wherein the weight ratio of complexing agent (A) to complexing agent (B) is in the range of from 10:1 to 1:10.

2. The aqueous formulation according to claim 1, wherein polymer (C) is selected from polyalkylenimines and polyvinylamines, partially or fully substituted with $CH_2COOH$ groups, partially or fully neutralized with alkali metal cations.

3. The aqueous formulation according to claim 1, wherein salt (D) is selected from potassium formate and potassium acetate.

4. The aqueous formulation according to claim 1, wherein said aqueous formulation has a pH value in the range of from 10.5 to 11, determined at a 1% by weight aqueous solution.

5. The aqueous formulation according to claim 1, wherein the weight ratio of complexing agent (A) to complexing agent (B) is in the range of from 4:1 to 1:4.

6. The aqueous formulation according to claim 1, wherein the weight ratio of complexing agent (A) to complexing agent (B) is in the range of from 1.5:1 to 1:1.5.

7. The aqueous formulation according to claim 1 wherein said aqueous formulation has a dynamic viscosity in the range of from 100 to 400 mPa·s, determined according to DIN 53018-1:2008-09 at 25° C.

8. The aqueous formulation according to claim 1 wherein said formulation has a total solids content in the range of 40 to 70%.

9. The aqueous solution according to claim 1 wherein complexing agent (B) is essentially L-glutamic acid (L-GLDA) that is at least partially neutralized with alkali metal.

10. The aqueous formulation according to claim 1 containing in the range of from 10 to 50% by weight of complexing agent (A), in the range of from 10 to 50% by weight of complexing agent (B), in the range of from zero to 5% by weight of polymer (C), in the range of from zero to 30% by weight of salt (D), percentages referring to the total solids of the respective aqueous solution.

11. The aqueous formulation according to claim 1 wherein such formulation is phosphate-free.

12. The aqueous formulation according to claim 1 wherein such formulation comprises a plasticizer.

13. A process for making an aqueous solution according to claim 1, comprising the step of combining an aqueous solution of complexing agent (A) with solid complexing agent (B) and salt (D).

14. The process for making an aqueous solution according to claim 1, comprising the steps of combining an aqueous solution of complexing agent (A) with an aqueous solution of complexing agent (B) and an aqueous solution of salt (D).

15. Use of aqueous solutions according to claim 1 for transportation in a pipe or a container.

* * * * *